US007699302B2

(12) United States Patent
Ichikawa

(10) Patent No.: US 7,699,302 B2
(45) Date of Patent: Apr. 20, 2010

(54) SHEET HANDLING APPARATUS CAPABLE OF EFFECTIVELY PERFORMING SHEET PROCESSING, AND AN IMAGE FORMING APPARATUS USING THE SAME

(75) Inventor: Mitsuru Ichikawa, Nagoya (JP)

(73) Assignee: Ricoh Co., Ltd., Tokyo (JP)

( * ) Notice: Subject to any disclaimer, the term of this patent is extended or adjusted under 35 U.S.C. 154(b) by 626 days.

(21) Appl. No.: 11/645,607

(22) Filed: Dec. 27, 2006

(65) Prior Publication Data

US 2007/0145661 A1 Jun. 28, 2007

(30) Foreign Application Priority Data

Dec. 28, 2005 (JP) ..... 2005-379284

(51) Int. Cl.
*B65H 37/04* (2006.01)

(52) U.S. Cl. ..... 270/58.12; 270/32; 270/37; 270/58.07; 270/58.08; 270/58.09; 270/58.11; 270/58.17; 270/58.27; 270/59

(58) Field of Classification Search ..... 270/32, 270/37, 58.07, 58.08, 58.09, 58.11, 58.12, 270/58.17, 58.27, 59
See application file for complete search history.

(56) References Cited

U.S. PATENT DOCUMENTS 5,524,873 A 6/1996 Hosoi
6,575,447 B2 * 6/2003 Yoshie et al. ..... 270/58.07
2004/0126163 A1 * 7/2004 Asami et al. ..... 399/410
2005/0067777 A1 * 3/2005 Ilda et al. ..... 271/303

FOREIGN PATENT DOCUMENTS

JP 2002-128383 5/2002
JP 2004-292163 10/2004

* cited by examiner

*Primary Examiner*—Gene Crawford
*Assistant Examiner*—Leslie A Nicholson, III
(74) *Attorney, Agent, or Firm*—Harness, Dickey & Pierce, P.L.C.

(57) ABSTRACT

A sheet handling apparatus comprises: a stacking mechanism to stack sheets of one or more printable media as a sheaf; a sheet conveyance mechanism to transport the sheaf to a respective position; a stapling mechanism to perform a stapling operation with respect to the sheaf; and a plurality of sheet regulating mechanisms disposed at positions spaced from each other along a sheet conveyance path, each sheet regulating mechanism being operable to align ends of the sheets in the sheaf according to a sheet conveyance direction. An image forming apparatus comprises such a sheet handling apparatus and an image forming device to form respective images upon the sheets and to provide the sheets to the sheet handling apparatus.

10 Claims, 7 Drawing Sheets

SHEET HANDLING APPARATUS CAPABLE OF EFFECTIVELY PERFORMING SHEET PROCESSING, AND AN IMAGE FORMING APPARATUS USING THE SAME

This patent specification is based on and claims priority under 35 U.S.C. §119 of Japanese patent application, No. JP2005-379284 filed on Dec. 28, 2005 in the Japanese Patent Office, the entire contents of which are incorporated herein by reference.

BACKGROUND

In recent years, there are various kinds of demands associated with sheet processing of documents output from image forming apparatuses such as a copier, a facsimile, a printer and so forth. Among such demands, in addition to the side stapling, there is a growing demand for saddle stitching in which a plurality of locations of the sheet, generally two locations, are stapled down at a given interval along a centerline dividing the sheet into half. When performing saddle stitching compared with the side stapling, a sheet conveyance distance will vary depending on the size of the sheet, as the sheet is transported to the position at which the saddle stitching is performed.

Related arts associated with the saddle stitching proposed in Japanese Patent Laid-Open Application Publications, No. 2002-128383 and No. 2004-292163, for example, are known. According to Japanese Patent Laid-Open Application Publications, No. 2002-128383 and No. 2004-292163, a rear end portion of a sheaf of paper in a conveyance direction stacked on a stacking mechanism is aligned by a rear-end plate, and subsequently, the rear-end plate retracts from the conveyance path so that the sheaf of paper is transported to a position at which the side stapling or the saddle stitching is performed. When the sheaf of paper reaches the stapling position, the conveyance operation is stopped, and a stapling operation is carried out.

According to the related arts, the end portion of the paper sheaf in the conveyance direction stacked on the stacking mechanism is in contact with the rear-end plate so that the paper sheaf in the sheet conveyance direction is aligned. At this time, the position of the rear-end plate is already fixed. Then, the rear-end plate is moved forward, i.e., away from the fixed position. As may be understood from the related arts, only a single rear-end plate is provided. Consequently, when large size paper such as A3 paper or Double Letter Size (DLT) is stacked on the stacking mechanism, the distance at which the paper sheaf conveyance mechanism carries the sheet so as to perform saddle stitch will be extended. As a result, the center portion of the paper sheaf projects causing the sheet to be misaligned during the transfer of the paper sheaf, or the positioning accuracy of the position of the saddle stitching is deteriorated due to variations in the conveyance amount of the paper sheaf, environment and so forth.

SUMMARY

In view of the foregoing, example embodiments of the present invention provide an image forming apparatus including a sheet handling mechanism which effectively performs sheet processing such as sheet alignment, binding, folding, punching and so forth with respect to a large size (i.e. A3 and DLT) sheet-type recording medium.

At least one embodiment of the present invention provides a sheet handling apparatus comprising: a stacking mechanism to stack sheets of one or more printable media as a sheaf; a sheet conveyance mechanism to transport the sheaf to a respective position; a stapling mechanism to perform a stapling operation with respect to the sheaf; and a plurality of sheet regulating mechanisms disposed at positions spaced from each other along a sheet conveyance path, each sheet regulating mechanism being operable to align ends of the sheets in the sheaf according to a sheet conveyance direction. An image forming apparatus comprises such a sheet handling apparatus and an image forming device to form respective images upon the sheets and to provide the sheets to the sheet handling apparatus.

At least one embodiment of the present invention provides an image forming apparatus comprising: such an image handling apparatus as mentioned above; and an image forming device to form respective images upon the sheets and to provide the sheets to the sheet handling apparatus.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
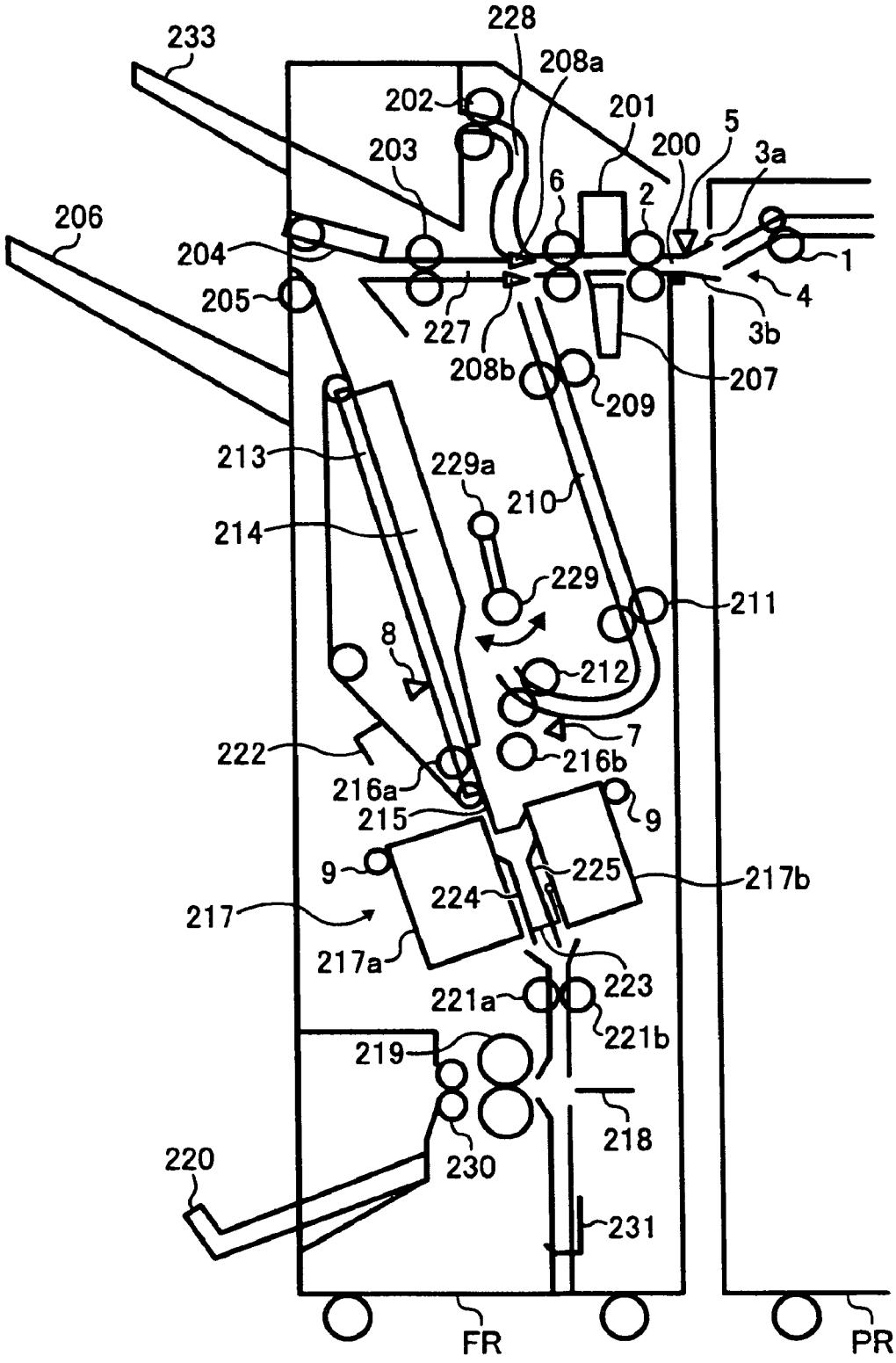
FIG. 1 is a schematic diagram illustrating a sheet handling mechanism according to an example embodiment of the present invention.

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Example embodiments of the present invention are now explained below with reference to the accompanying drawings. In the later described comparative example, example embodiment, and alternative example, the same reference numerals will be given to constituent elements such as parts and materials having the same functions, and the descriptions thereof will be omitted. Referring now to the drawings, wherein like reference numerals designate identical or corresponding parts throughout the several views, particularly to FIG. 1, a structure of a sheet processing apparatus according to an example embodiment of the present invention is described.

Figure 2:
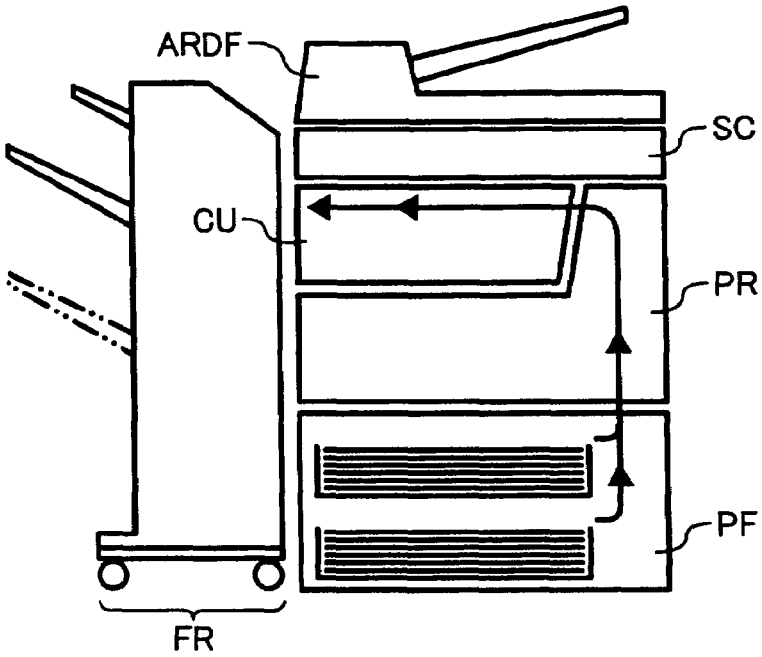
FIG. 2 is a schematic diagram illustrating an image forming system (according to an example embodiment of the present invention) of an example copier including the sheet handing apparatus shown in FIG. 1.
Figure 3:
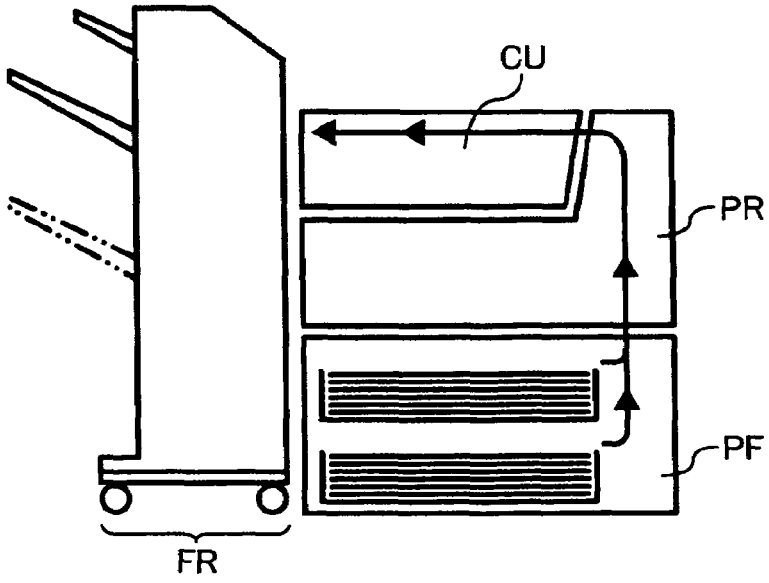
FIG. 3 is a schematic diagram illustrating an image forming system (according to an example embodiment of the present invention) of a printer including the sheet handing apparatus shown in FIG. 1.

FIG. 1 is a schematic diagram illustrating a sheet handling apparatus of an example embodiment of the present invention. FIGS. 2 and 3 are schematic diagrams illustrating an image forming system including the sheet handling apparatus of FIG. 1. FIG. 2 illustrates a system of a copier which includes an image forming apparatus (PR), a paper feeder (PF) for supplying paper to the image forming apparatus (PR), a scanner (SC) for reading an image, and an automatic recirculatory document feeder (ARDF). Typically, but not necessarily, paper is the medium from which is made a sheet on which an image is to be formed. Other printable media is available in sheets and their use here is included. For simplicity, this Detailed Description section refers to paper, sheets thereof, paper feeder, etc. It should be understood, however, that the sheets, etc., are not limited only to paper. The sheet, on which an image is formed by the image forming apparatus PR, is transferred to a guide plate at an entry of a finisher FR through a communication unit CU.

FIG. 3 illustrates a system of a copier without the scanner SC and the automatic recirculatory document feeder ARDF, and other structures are similar to that of the copier described above. The sheet handling apparatus indicated herein as the finisher FR is installed on the side of the image forming apparatus PR as shown in FIG. 3. The sheet ejected from the image forming apparatus PR is guided to the sheet handling apparatus FR. Various processing is carried out on the sheet by the functions of the sheet handling apparatus FR. The image forming apparatus PR may be of an apparatus with known image forming functions, for example, an apparatus of an image forming process of an electrophotographic method and an apparatus with inkjet-type print heads.

In the sheet handling apparatus FR, the sheet, which is transferred from a sheet eject roller 1 of the image forming apparatus PR, passes through the conveyance path 200 having a sheet handling mechanism for performing post-processing on a sheet of paper as shown in FIG. 1. In the example embodiment, the sheet handling mechanism herein includes a punching unit 201 as a punching mechanism. Separation claws 208*a* and 208*b* sort the sheet into an upper conveyance path 228 leading the sheet to a proof tray 233, an intermediate conveyance path 227 leading the sheet to a catch tray 206, and a lower conveyance path 210 leading the sheet to a staple tray 213 which serves as a stacking mechanism. The sheets, which are transferred onto the staple tray 213 by conveyance rollers 209, 211 and 212, are aligned on the staple tray 213 by a jogger fence 214 in a direction perpendicular to a sheet conveyance direction. For convenience, a collection of sheets such as those disposed in the staple tray 213 are referred to as a sheaf, albeit without the intent to imply that the collection necessarily is bound together in some manner. A sheaf can become bound by, e.g., a staple, etc., but is not necessarily bound by virtue of being referred to as a sheaf.

The paper sheaf is then aligned by a tapping roller 229 based on a rear-end plate 215 serving as a first sheet regulating mechanism. Subsequently, in a case of the side-stapling, stapling processing is performed on the paper sheaf at a given position. The paper sheaf is transferred in an upward direction by a release claw 222, is ejected to the catch tray 206 by a release roller 205, and is stacked. The conveyance path 200 is provided with guide plates 3*a* and 3*b* that are connected to a sheet ejection opening 4 so that jamming is reduced if not prevented when the paper sheaf is received from the image forming apparatus PR.

On the other hand, in a case of the saddle stitching, the paper sheaf is nipped by paper sheaf conveyance rollers 216*a* and 216*b* serving as a sheet conveyance mechanism after the paper sheaf is aligned on the staple tray 213. Subsequently, a driving mechanism (not shown) causes the rear-end plate 215 to retract from the conveyance path so that the paper sheaf is transported in a downward direction. At the saddle stitching position, the saddle stitching processing is performed on the paper sheaf by a staple unit 217 serving as a stapling mechanism equipped with a stitcher 217*a* and a clincher 217*b*. When the saddle stitching processing is finished, the paper sheaf is transported to a position in the vicinity to a stopper 231 by paper sheaf conveyance rollers 221*a* and 221*b*. The stopper 231 transports the paper sheaf to a paper folding position. Then, center folding processing is performed by a folding plate 218 and a pair of folding rollers 219. The paper sheaf is ejected to a catch tray 220 by a sheet ejection roller 230 and is stacked.

Figure 4:
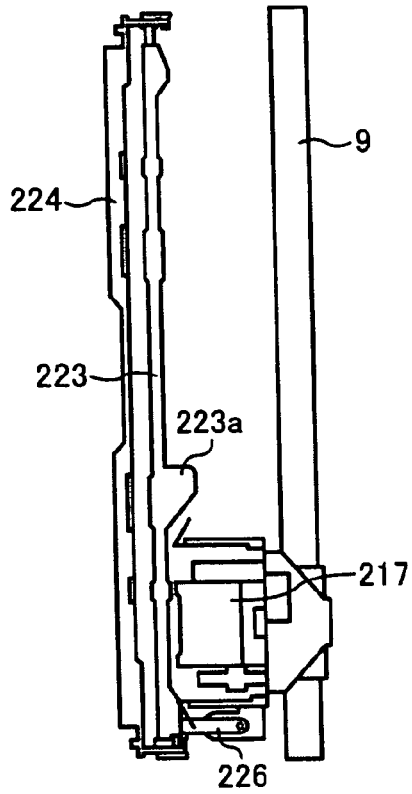
FIG. 4 is a schematic diagram illustrating (according to an example embodiment of the present invention) a staple unit at a home position.
Figure 5:
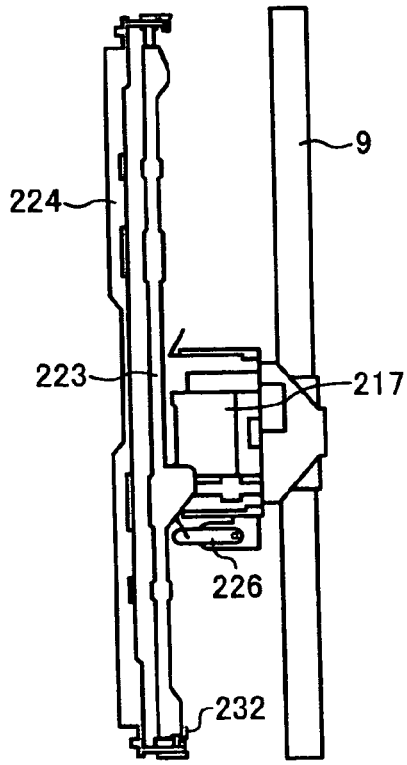
FIG. 5 is a schematic diagram illustrating (according to an example embodiment of the present invention) the staple unit shown in FIG. 4 immediately before pressing a protrusion on a bottom-end plate.
Figure 6:
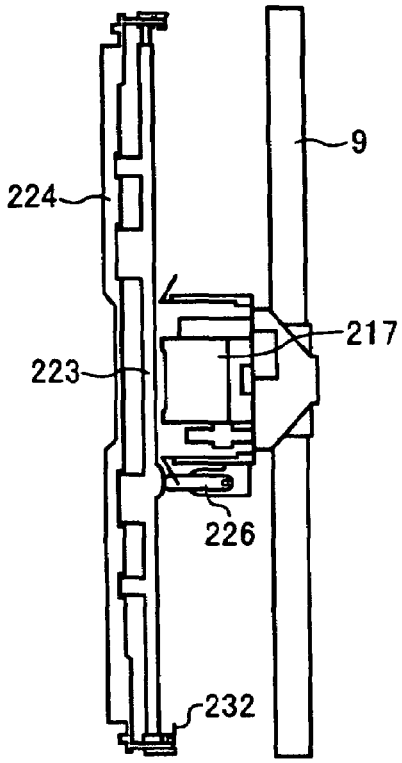
FIG. 6 is a schematic diagram illustrating (according to an example embodiment of the present invention) the staple unit at a center position after pressing the protrusion.

In a case where a large size paper sheet such as A3, DLT and so forth having a long width in a conveyance direction is saddle stitched, the rear-end plate 215 retracts from the conveyance path at the start of copying. FIG. 4 illustrates the staple unit 217 in a home position. The staple unit 217 is moved by the driving mechanism (not shown) from the home position as shown in FIG. 4 to a center position in a direction perpendicular to the sheet conveyance direction as shown in FIG. 6. Accordingly, a lever 226 of a one-way clutch attached to a clincher 217*b* presses a protrusion 223*a* of a bottom-end plate 223 (the bottom-end plate 223 serving, e.g., as a second sheet regulating mechanism) so that the bottom-end plate 223 rotates and projects into a conveyance path formed of a left guide panel 224 and a right guide panel 225. Then, the bottom-end plate 223 is set to a position at which a paper sheaf is stopped. The bottom-end plate 223 is biased in a direction retracting from the conveyance path by a spring 232 as shown in FIG. 5. In a state where the protrusion 223*a* is not pressed, the bottom-end plate 223 retracts from the conveyance path.

In other words, in the example embodiment, in addition to the rear-end plate 215 which operates in the vicinity to the entrance of the staple unit 217 as shown in FIG. 1, the bottom-end plate 223, which operates in the vicinity of the exit of the staple unit 217 in the sheet conveyance direction, is advancably and retractably provided. The paper sheaf transferred on the staple tray 213 by the conveyance rollers 209, 211 and 212 is aligned by the tapping roller 229 based on the bottom-end plate 223 in the conveyance direction.

When operating as shown in FIG. 6, as the bottom-end plate 223 operates, the staple unit 217 is positioned at the center in a direction perpendicular to the sheet conveyance direction or the sheet width direction. As a result, the conveyance resistance caused by the staple unit 217 in the direction perpendicular to the sheet conveyance direction is stabilized, thereby reducing if not preventing a corner portion of the sheet that is curled from being caught. Accordingly, an occurrence of the paper jam is suppressed, and further, the alignment accuracy of the paper sheaf stacked on the bottom-end plate 223 is enhanced.

When the paper sheet such as A3, DLT and so forth having a long width in a conveyance direction is aligned based on the bottom-end plate 223, the paper conveyance distance to the saddle stitch position may be shortened, and the projection of the center portion of the paper sheaf may be reduced if not prevented. Furthermore, variations in the paper conveyance distance due to the paper types and the environment may be suppressed. Accordingly, the alignment accuracy of the paper sheaf and the positional accuracy of the saddle stitching position may be enhanced.

Figure 7:
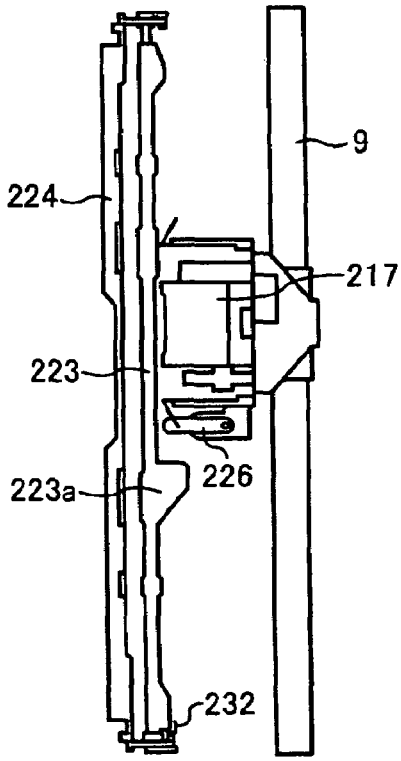
FIG. 7 is a schematic diagram illustrating (according to an example embodiment of the present invention) the staple unit traveling from the center position to a first stapling position.
Figure 8:
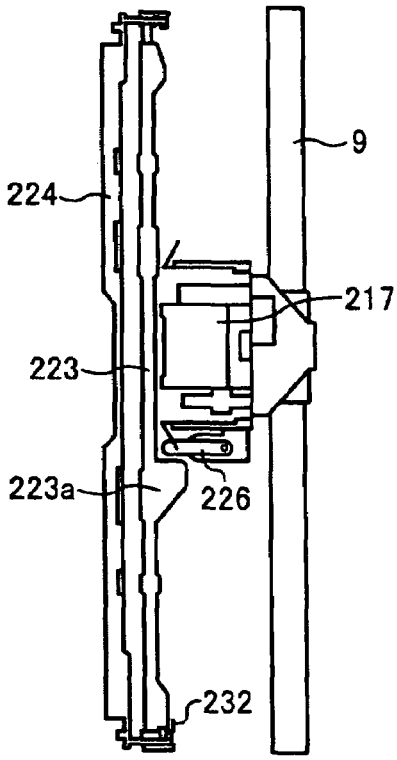
FIG. 8 is a schematic diagram illustrating (according to an example embodiment of the present invention) a lever of the staple unit coming into contact with the protrusion.
Figure 9:
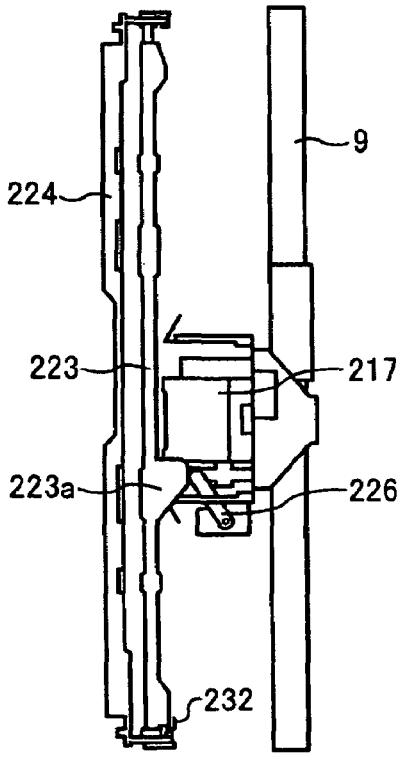
FIG. 9 is a schematic diagram illustrating (according to an example embodiment of the present invention) the lever rotating when the lever comes into contact with the protrusion.

After the paper sheaf is aligned, the paper sheaf is nipped by the paper sheaf conveyance rollers 216*a* and 216*b*. Then, the staple unit 217 moves from the center position shown in FIG. 6 to the position shown in FIG. 7 in the direction retracting from the home position. When the paper sheaf is moved to a first saddle stitching position, the lever 226 is released from the protrusion 223*a*, and the bottom-end plate 223 is retracted from the conveyance path by the spring 232. When the paper sheaf is transported to the saddle stitching position, the staple unit 217 performs stapling processing for a first saddle stitch. When the first stapling operation is finished, the staple unit 217 moves in the direction towards the home position and then moves to the second saddle stitching position. FIG. 8 illustrates the lever 226 of the staple unit coming into contact with the protrusion when the staple unit moves from the first stapling position to the second stapling position. FIG. 9 illustrates the lever 226 rotating when the lever 226 comes into contact with the protrusion 223*a*.

Figure 10A:
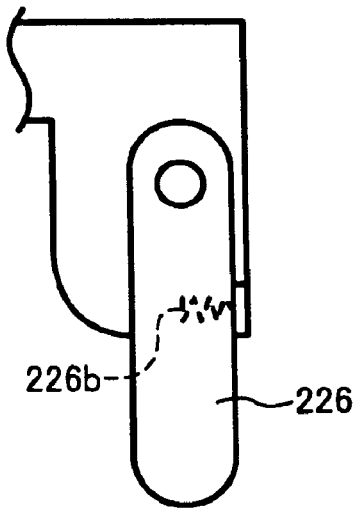
FIG. 10A is a schematic diagram illustrating (according to an example embodiment of the present invention) the lever at an initial position.
Figure 10B:
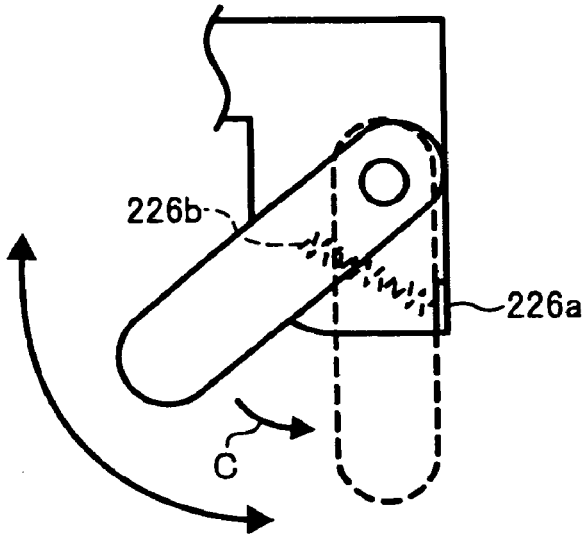
FIG. 10B is a schematic diagram illustrating (according to an example embodiment of the present invention) a movement of the lever.

FIG. 10A illustrates the lever 226 before its rotation. FIG. 10B illustrates the rotation of the lever 226. The lever 226 is biased by a spring 226*b* so that the lever 226 comes into contact with a stopper 226*a*. The lever 226 is configured, e.g., such that the lever 226 is only rotatable from the state shown in FIG. 10A to the state shown in FIG. 10B in the direction as shown by an arrow in FIG. 10B. As shown in FIGS. 8, 9 and 10, when the staple unit 217 moves in the direction of the home position, the lever 226 comes into contact with the protrusion 223*a* and rotates to the position as shown in FIG. 10B. Accordingly, the bottom-end plate 223 is set to the conveyance path so that it does not advance, thereby reducing if not preventing the paper sheaf from getting damaged. The relationship between a force A acting upon the lever 226 in an arrow C direction in FIG. 10B and a force B of the spring 232 acting upon the bottom-end plate 223 is configured to be A<B.

If the rotary mechanism such as the lever 226 as shown in FIGS. 10A and 10B is not provided, after the first stapling processing is finished, the paper sheaf is transported by the paper sheaf conveyance rollers 216*a* and 216*b* in a returning direction such that the rear end of the paper sheaf is positioned further upward than the bottom-end plate 223. Subsequently, the staple unit 217 needs to be moved in the direction towards the home position. Consequently, the productivity may be adversely affected, and paper creases may occur. Furthermore, if the bottom-end plate 223 is configured to be set to the conveyance path at the home position as shown in FIG. 4, the moving distance of the staple unit 217 may be extended when the paper sheaf is saddle-stitched at two places in the center thereof. Consequently, the productivity may be reduced.

When the paper sheaf is moved to the second stapling position, and the stapling processing is finished, the paper sheaf is transported to the vicinity of the stopper 231 by the paper sheaf conveyance rollers 221*a* and 221*b*. The paper sheaf is then transported to the folding position by the stopper 231. Subsequently, the center folding processing is carried out by the folding plate 218 and the pair of folding members 219. The paper sheaf is ejected and stacked on the catch tray 220 by the sheet ejection roller 230.

The conveyance path 200 is common to the upper conveyance path 228, the intermediate conveyance path 227 and the upstream of the lower conveyance path 210. Along the conveyance path 200 there are provided: an entrance sensor 5 for detecting a sheet received from the image forming apparatus PR; conveyance rollers 2, the punching unit 201 and a punch waste hopper 207 disposed downstream of the entrance sensor 5; and conveyance rollers 6 and the separation claws 208*a* and 208*b* disposed further downstream, respectively.

The separation claws 208*a* and 208*b* are each held by a spring (not shown) in the state as shown in FIG. 1, and are individually rotated, when solenoids, each of which is connected to the respective separation claws 208*a* and 208*b*, are turned ON. When the separation claw 208*a* is rotated, the sheet is sorted in the direction towards the upper conveyance path 228 and is ejected to the proof tray 233 by sheet ejection rollers 202. When the separation claw 208*b* is rotated, the sheet is sorted into the lower conveyance path 210 and is transported to the staple tray 213 by the conveyance rollers 209, 211 and 212. When the two solenoids are in an off state, the sheet is sorted into the intermediate conveyance path 227 and is transported to the catch tray 206 by shift rollers 203, a sheet ejection guide plate 204 and the release roller 205.

The intermediate conveyance path 227 is provided with the shift rollers 203 which may move the sheet by a certain amount in a direction perpendicular to the conveyance direction. The shift rollers 203 carry out a shift operation, when the shift rollers 203 are moved in the direction perpendicular to the conveyance direction by the driving mechanism (not shown). The sheet transported to the intermediate conveyance path 227 by the conveyance rollers 6 moves by the certain amount in the direction perpendicular to the conveyance direction while the sheet is transferred by the shift rollers 203. Consequently, the sheet is shifted by a certain amount in the direction perpendicular to the conveyance direction, is ejected by the release roller 205, and is stacked on the catch tray 206. Thereby, sorting of the paper sheaf is made possible.

A sheet eject sensor 7 is provided to the lower conveyance path 210, detects the sheet being transported, and triggers a sheet alignment operation when the sheet is ejected on the staple tray 213.

The rear end of the sheet ejected on the staple tray 213 is aligned based on the rear-end plate 215 serving as a first paper sheaf handling mechanism. The rear-end plate 215 is driven by a stepping motor and a driving cam (not shown) so as to retract from the conveyance path reducing if not preventing interference during the transportation of the paper sheaf to the saddle stitching position.

The paper sheaf stacked on the staple tray 213 is dropped below by the tapping roller 229 as needed. The lower end of the paper sheaf is aligned. A tapping solenoid (not shown) causes the tapping roller 229 to pendulate with a pivot point 229*a* in the center. The tapping roller 229 intermittently taps the sheet being received against the rear-end plate 215. The tapping roller 229 rotates in a direction that allows the sheet to be transferred to the rear-end plate 215 in a counterclockwise direction. The paper sheaf stacked on the staple tray 213 is aligned in the conveyance direction and in a direction at a right angle by the jogger fence 214.

The jogger fence 214 is driven by a jogger motor (not shown) which forwardly and reversibly rotates, and is moved back and forth in the sheet conveyance direction and the direction at a right angle, thereby pressing the end face of the sheet and aligning the sheet in the conveyance direction and in the direction at a right angle. This sheet alignment operation is performed as needed while the sheet is being stacked and after the last sheet is stacked.

A sensor 8 provided to the staple tray 213 is a sheet detecting sensor for detecting whether or not the sheet is on the staple tray 213. The tapping roller 229, the rear-end plate 215 and the jogger fence 214 comprise the sheet alignment mechanism that allows the alignment of the paper sheaf in a parallel direction and in a direction at a right angle relative to the sheet conveyance direction.

The paper sheaf conveyance rollers 216*a* and 216*b*, and 221*a* and 221*b* are capable of pressing and releasing motions. When the paper sheaf conveyance rollers 216*a* and 216*b*, and 221*a* and 221*b* are in a release state, the paper sheaf is transported therebetween. Subsequently, the paper sheaf conveyance rollers 216*a* and 216*b*, and 221*a* and 221*b* transport the paper sheaf while applying pressure thereto. A stepping motor (not shown) drives the conveyance motion. By controlling the amount of the sheet conveyance, it is made possible to transfer the paper sheaf to the saddle stitching position and to the position in the vicinity of the stopper 231.

The staple unit 217 includes a stitcher 217*a* which inserts staples and a clincher 217*b* which clinches the tip of the staple that is stapled down the paper sheaf. In the staple unit 217 according to the example embodiment, the stitcher 217*a* and the clincher 217*b* are separately formed and are made movable in the direction perpendicular to the paper sheaf conveyance direction by stapler guides 9. The stitcher 217*a* and the clincher 217*b* are equipped with a relative positioning mechanism (not shown) and a moving mechanism (not shown). The staple position of the paper sheaf in the conveyance direction is determined by the conveyance control of the paper sheaf conveyance rollers 216*a* and 216*b*. Accordingly, stapling at different positions on the paper sheaf is made possible.

On the downstream side of the sheet conveyance direction of the staple unit 217 or a downstream side of the folding sheet is provided a center-folding mechanism. The center-folding mechanism includes the folding plate 218, a pair of folding rollers 219 and the stopper 231. The paper sheaf stapled in the center thereof in the sheet conveyance direction by the staple unit 217 located on the upstream is transported to the position near the stopper 231 by the paper sheaf conveyance rollers 221*a* and 221*b*. The folding position of the paper sheaf is determined, when the nip pressure of the paper sheaf conveyance rollers 221*a* and 221*b* is released so that the paper sheaf is dropped on the stopper 231, and then the stopper 231 is raised to a given position. The paper sheaf stopped at the folding position, that is, normally at the center in the paper sheaf conveyance direction, is pressed into the nip of the folding roller pair 219 by the folding plate 218. The folding roller pair 219 then presses the paper sheaf and rotates so as to transfer the paper sheaf. Accordingly, the paper sheaf is folded in the center thereof. The folded paper sheaf is ejected and stacked on the catch tray 220 by the sheet ejection roller 230.

Figure 11:
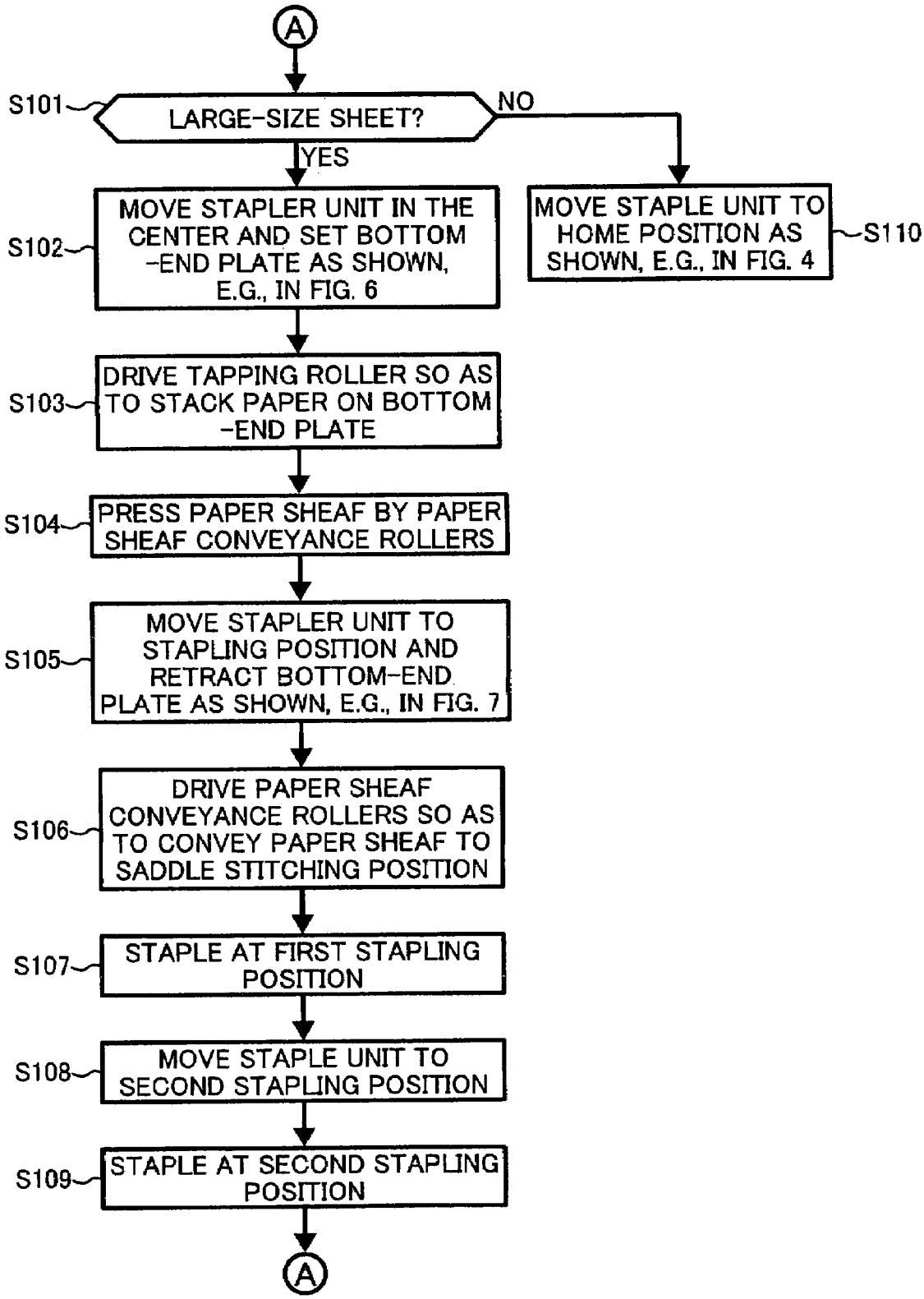
FIG. 11 is a flowchart (according to an example embodiment of the present invention) showing an example procedure of a saddle stitching mode.

FIG. 11 is a flowchart illustrating an example procedure of a saddle stitching mode. In the saddle stitching mode, as shown in FIG. 11, whether or not the sheet to be saddle-stitched is a large-size or a small-size is determined (Step S101). The large-size herein refers to sizes such as A3, DLT and the like. If the sheet size is determined as the large size in Step S101, the staple unit 217 is moved to the center, and the bottom-end plate 223 is set in a manner as shown in FIG. 6 (Step S102). Subsequently, the tapping roller 229 is driven so as to stack the sheets on the bottom-end plate 223 (Step S103). After the stacked sheets are aligned in the sheet conveyance direction and in the direction perpendicular to the sheet conveyance direction, the paper sheaf is pressed by the paper sheaf conveyance rollers 216*a* and 216*b* (Step S104). The staple unit 217 is then moved to the stapling position, and the bottom-end plate 223 is retracted as shown in FIG. 7 (Step S105).

When the bottom-end plate 223 is retracted, the paper sheaf conveyance rollers 216*a* and 216*b* are driven so that the paper sheaf is transported to the saddle stitching position (Step S106). Then, the stitcher 217*a* and the clincher 217*b* carry out stapling at the first staple position (Step S107). Subsequently, the staple unit 217 is moved to the second staple position as shown in FIG. 9 (Step S108) and carries out stapling at the second staple position (Step S109).

If, on the other hand, the sheet size is determined not as a large-size in Step S101, the staple unit 217 is retuned to the home position, and the bottom-end plate 223 is retracted from the sheet conveyance path (Step S110).

The operation of the saddle-stitching mode is performed by carrying out a program stored in a ROM (not shown) while a CPU of the control circuit (not shown) uses a RAM (not shown) as a work area.

According to the example embodiment, the bottom-end plate 223 is advancably and retractably provided at the paper sheaf regulating position in the conveyance path below the rear-end plate 215. Therefore, it may be possible to align the sheet in the conveyance direction by the bottom-end plate 223 when the large-size sheet, for example, A3 and DLT is stacked on the stack mechanism. Accordingly, the paper sheaf conveyance distance to the saddle stitching position is reduced, thereby enabling effective processing. In addition, it may be possible to enhance the paper sheaf alignment accuracy and the positioning accuracy of the saddle stitching position.

According to the example embodiment, the staple unit 217 is movably disposed in the direction perpendicular to the conveyance direction, and the shift of the staple unit 217 enables the bottom-end plate 223 to advance and retract to the paper sheaf regulating position in the conveyance path. Thereby, a driving device designated to the bottom-end plate 223 may not be needed, and it may be possible to restrict the rear end of the paper sheaf.

According to the example embodiment, when the staple unit 217 moves from the home position to the center position in the direction perpendicular to the conveyance direction, the bottom-end plate 223 is set at the paper sheaf regulating position in the conveyance path. Accordingly, when stacking the sheet on the bottom-end plate 223, the resistance force of the staple unit 217 may uniformly be applied. As a result, it may be possible to reduce if not prevent the paper skew and to enhance the alignment accuracy of the paper sheaf.

When the staple unit 217 moves from the center position to the direction further away from the home position, the bottom-end plate 223 retracts from the paper sheaf regulating position in the conveyance path. When the staple unit 217 moves in the direction towards the home position from that state, the bottom-end plate 223 will not be set at the paper sheaf regulating position. Consequently, after stacking the sheets, the paper sheaf is transferred to the saddle stitching position by the paper sheaf conveyance rollers 216*a* and 216*b*. The paper sheaf is continuously stapled at two places in the center of the sheaf when the rear-end of the paper sheaf is positioned below the bottom-end plate 223.

According to the example embodiment, the relationship between the force A acting upon the lever 226 and the force B acting upon the bottom-end plate 223 is configured to be A<B. Accordingly, when the staple unit 217 moves in the home position direction, the lever 226 rotates, thereby making it possible to continuously staple at two places in the center without having the bottom-end plate 223 to protrude into the conveyance path.

As described above, according to at least one of the example embodiments, it is possible to continuously staple at two places in the center. Therefore, it may be possible to improve the productivity.

One or more embodiments of the present invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus comprising:

an image forming device to form respective images upon sheets of one or more recording media, respectively; and a sheet handling mechanism to receive the sheets from the image forming device, the sheet handling mechanism including the following, a stacking mechanism to stack the sheets as a sheaf, a sheet conveyance mechanism to transport the sheaf to a respective position, a stapling mechanism to perform a stapling operation with respect to the sheaf, and a plurality of sheet regulating mechanisms disposed at positions spaced from each other along a sheet conveyance path, each sheet regulating mechanism being operable to align ends of the sheets in the sheaf according to a sheet conveyance direction wherein the plurality of sheet regulating mechanisms includes a second sheet regulating mechanism that advances and retracts relative to a sheet regulating position according to motion of the stapling mechanism, the sheet handling mechanism further includes a first biasing mechanism to bias the second sheet regulating mechanism in a direction retracting away from the sheet regulating position, the stapling mechanism causes the second sheet regulating mechanism to be set at the sheet regulating position when the stapling mechanism travels from a home position to a given traversal position, the second regulating mechanism includes a projection arranged at a position under the given traversal position of the stapling mechanism and facing the stapling mechanism in a direction opposite to the sheet conveyance direction, and the stapling mechanism further includes a one-way clutch to push the projection of the second regulating mechanism so that the second regulating mechanism is set at the sheet regulating position when the stapling mechanism is positioned at the given traversal position.

2. The image forming apparatus according to claim 1, wherein the plurality of sheet regulating mechanisms includes a first sheet regulating mechanism provided at an upstream position from the stapling mechanism in the sheet conveyance direction and the second sheet regulating mechanism is provided at a downstream position from the stapling mechanism in the sheet conveyance direction.

3. The image forming apparatus according to claim 1, wherein the stapling mechanism stays at a home position and traverses the sheet conveyance path back and forth in directions perpendicular to the sheet conveyance direction, and performs the stapling operation on the sheaf of sheet recording mediums aligned by one of a first sheet regulating mechanism of the plurality of sheet regulating mechanisms and the second sheet regulating mechanism.

4. The image forming apparatus according to claim 1, wherein;

the one-way clutch includes the following, a stopper, a second biasing mechanism, and a lever having a first surface facing an end of a path traversable by the stapling mechanism away from the home position, a second surface arranged opposite to the first surface, and a top surface facing the second regulating mechanism, the lever being swingably biased against the stopper by the second biasing mechanism, wherein when the stapling mechanism travels from the home position and reaches the given traversal position, the lever pushes the projection of the second regulating mechanism with the top surface thereof so that the second regulating mechanism is set at the sheet regulating position, wherein when the stapling mechanism is positioned out of the given traversal position, the lever is free from the second regulating mechanism so that the second regulating mechanism retracts away from the sheet regulating position by a motion of the first biasing mechanism, and wherein when the stapling mechanism is caused to return towards the home position and reaches the given traversal position, the lever is caused to swing away from the stopper by the projection of the second regulating mechanism.

5. The image forming apparatus according claim 4, wherein the first and second biasing mechanisms satisfy a relationship A<B, wherein A is a biasing force of the second biasing mechanism and B is a biasing force of the first biasing mechanism.

6. A sheet handling apparatus comprising:

a stacking mechanism to stack sheets of one or more printable media as a sheaf;

a sheet conveyance mechanism to transport the sheaf to a respective position;

a stapling mechanism to perform a stapling operation with respect to the sheaf; and a plurality of sheet regulating mechanisms disposed at positions spaced from each other along a sheet conveyance path, each sheet regulating mechanism being operable to align ends of the sheets in the sheaf according to a sheet conveyance direction, wherein the plurality of sheet regulating mechanisms includes a second sheet regulating mechanism that advances and retracts relative to a sheet regulating position according to motion of the stapling mechanism, the sheet handling apparatus further includes a first biasing mechanism to bias the second sheet regulating mechanism in a direction retracting away from the sheet regulating position, the stapling mechanism causes the second sheet regulating mechanism to be set at the sheet regulating position when the stapling mechanism travels from a home position to a given traversal position, the second regulating mechanism includes a projection arranged at a position under the given traversal position of the stapling mechanism and facing the stapling mechanism in a direction opposite to the sheet conveyance direction, and the stapling mechanism further includes a one-way clutch to push the projection of the second regulating mechanism so that the second regulating mechanism is set at the sheet regulating position when the stapling mechanism is positioned at the given traversal position.

7. The sheet handling apparatus according to claim 6, wherein the plurality of sheet regulating mechanisms includes a first sheet regulating mechanism provided at an upstream position from the stapling mechanism in the sheet conveyance direction and the second sheet regulating mechanism is provided at a downstream position from the stapling mechanism in the sheet conveyance direction.

8. The sheet handling apparatus according to claim 6, wherein the stapling mechanism stays at a home position and traverses the sheet conveyance path back and forth in directions perpendicular to the sheet conveyance direction, and performs the stapling operation on the sheaf of sheet recording mediums aligned by one of a first sheet regulating mechanism and the second sheet regulating mechanism.

9. The sheet handling apparatus according to claim 6, wherein;

the one-way clutch includes the following, a stopper, a second biasing mechanism, and a lever having a first surface facing an end of a path traversable by the stapling mechanism away from the home position, a second surface arranged opposite to the first surface, and a top surface facing the second regulating mechanism, the lever being swingably biased against the stopper by the second biasing mechanism, wherein when the stapling mechanism travels from the home position and reaches the given traversal position, the lever pushes the projection of the second regulating mechanism with the top surface thereof so that the second regulating mechanism is set at the sheet regulating position, wherein when the stapling mechanism is positioned out of the given traversal position, the lever is free from the second regulating mechanism so that the second regulating mechanism retracts away from the sheet regulating position by a motion of the first biasing mechanism, and wherein when the stapling mechanism is caused to return towards the home position and reaches the given traversal position, the lever is caused to swing away from the stopper by the projection of the second regulating mechanism.

10. The sheet handling apparatus according claim 9, wherein the first and second biasing mechanisms satisfy a relationship A<B, wherein A is a biasing force of the second biasing mechanism and B is a biasing force of the first biasing mechanism.

* * * * *